US008895091B2

(12) United States Patent
Boyer

(10) Patent No.: US 8,895,091 B2
(45) Date of Patent: Nov. 25, 2014

(54) COVER SHELL FOR REDUCING DAMAGE TO FOOD PRODUCT

(71) Applicant: Schwan's Global Supply Chain, Inc., Marshall, MN (US)

(72) Inventor: Stephen Richard Boyer, Birdsboro, PA (US)

(73) Assignee: Schwan's Global Supply Chain, Inc., Marshall, MN (US)

( * ) Notice: Subject to any disclaimer, the term of this patent is extended or adjusted under 35 U.S.C. 154(b) by 0 days.

(21) Appl. No.: 13/782,737

(22) Filed: Mar. 1, 2013

(65) Prior Publication Data

US 2013/0327777 A1 Dec. 12, 2013

Related U.S. Application Data

(60) Provisional application No. 61/656,866, filed on Jun. 7, 2012.

(51) Int. Cl.

| | |
|---|---|
| ***B65D 85/36*** | (2006.01) |
| ***A47G 23/00*** | (2006.01) |
| ***B65D 25/10*** | (2006.01) |
| ***B65D 43/02*** | (2006.01) |

(52) U.S. Cl.

CPC ..... *A47G 23/00* (2013.01); *B65D 85/36* (2013.01); *B65D 25/107* (2013.01); *B65D 43/0212* (2013.01); *B65D 2543/00296* (2013.01); *B65D 25/10* (2013.01); *B65D 43/0214* (2013.01); *B65D 2543/00092* (2013.01); *B65D 2543/00361* (2013.01); *B65D 2543/00407* (2013.01); *B65D 2543/00527* (2013.01); *B65D 2543/00537* (2013.01)

USPC ..... 426/112; 426/128; 426/394; 426/397; 220/608; 220/671; 220/675; 206/551; D7/610

(58) Field of Classification Search

CPC ..... B65D 85/36; B65D 85/30; B65D 41/18; B65D 7/00; B65D 11/00; B65D 11/20; B65D 11/22; B65D 11/24; B65D 25/00; B65D 25/103; B65D 25/107; B65D 1/34; B65D 1/40; B65D 1/42; B65D 43/02; B65D 43/0214; B65D 43/0216; B65D 43/0218; B65D 43/0222; B65D 77/20; B65D 2543/00092; B65D 2543/00342; B65D 2543/00351; B65D 2543/00361; B65D 2543/00444; A47J 27/00; A47J 37/00; A47J 47/02; A47J 47/08; A47J 47/12; A47J 47/14; A45C 11/20

USPC ..... 426/106, 112, 115, 128, 394, 397; 220/608, 606, 796, 780, 23.89, 573.1, 220/602, 669–675; 206/551; D7/610

See application file for complete search history.

(56) References Cited

U.S. PATENT DOCUMENTS 3,303,964 A * 2/1967 Luker ..... 206/519
3,737,068 A 6/1973 Bird (Continued)

OTHER PUBLICATIONS

International Search Report and Written Opinion for PCT/US2013/044684 mailed Aug. 19, 2013.

*Primary Examiner* — Drew Becker
(74) *Attorney, Agent, or Firm* — Merchant & Gould P.C.

(57) ABSTRACT

A cover shell and container assembly comprising the cover shell and a tray or pan is disclosed. The cover shell includes inward projecting standoffs which restrict movement of a food product in the pan or tray and reduces damage to decorative elements of the food product during distribution and/or transport.

32 Claims, 7 Drawing Sheets

(56) References Cited

U.S. PATENT DOCUMENTS

| | | | | | |
|---|---|---|---|---|---|
| 3,770,115 | A | | 11/1973 | Cannell | |
| 3,865,953 | A | * | 2/1975 | Peters | 426/124 |
| 4,061,241 | A | | 12/1977 | Retelny | |
| 4,313,542 | A | | 2/1982 | Roberts et al. | |
| 4,339,041 | A | | 7/1982 | Roberts et al. | |
| 4,432,489 | A | | 2/1984 | Cote | |
| 4,472,440 | A | * | 9/1984 | Bank | 426/128 |
| 4,762,232 | A | | 8/1988 | Sedutto et al. | |
| 4,874,083 | A | | 10/1989 | Antoni et al. | |
| 5,269,430 | A | | 12/1993 | Schlaupitz et al. | |
| 5,287,959 | A | | 2/1994 | Hansen et al. | |
| 5,441,166 | A | * | 8/1995 | Lucas et al. | 220/782 |
| 5,600,889 | A | * | 2/1997 | Marotta | 30/142 |
| 5,858,428 | A | * | 1/1999 | Truscello et al. | 426/115 |
| 5,860,549 | A | * | 1/1999 | Allers et al. | 220/4.23 |
| 6,033,699 | A | * | 3/2000 | Vincenzi | 426/106 |
| 6,595,366 | B1 | * | 7/2003 | Brown | 206/551 |
| 6,698,336 | B1 | | 3/2004 | Siegel et al. | |
| 7,258,905 | B2 | | 8/2007 | Whitmore et al. | |
| 7,955,671 | B2 | | 6/2011 | Van Handel et al. | |
| 8,047,500 | B2 | | 11/2011 | Bergeret | |
| 2006/0266754 | A1 | | 11/2006 | Carmona | |
| 2010/0170899 | A1 | * | 7/2010 | Mithal et al. | 220/260 |

* cited by examiner

COVER SHELL FOR REDUCING DAMAGE TO FOOD PRODUCT

This application claims priority to U.S. application Ser. No. 61/656,866 filed Jun. 7, 2012, which is hereby incorporated by reference in its entirety.

BACKGROUND

Containers are commonly used for packing and transporting food products, such as bakery goods. Because bakery goods, such as pies, cakes, brownies, or cookies, often include decorative cream, frosting, or icing elements that can be damaged during transport or distribution, various types of containers have been developed in an effort to protect the food product during transport and/or distribution. These containers have included stiffening ribs, shock absorbing shells and bases, and/or additional packing material. One example container configuration has a dome-shaped cover (or lid, referred to collectively as "cover shell" unless the context indicates otherwise) made of an inexpensive and lightweight transparent plastic material. The cover is typically configured to engage a peripheral rim or sidewall element of the tin or pan holding the bakery good. One drawback with this type of packaging configuration, however, is the inability of the cover to keep the bakery good stable during transportation. The bakery good can slide inside the pan, lift out of the pan, or smear along the sides or top of the cover thereby ruining the decorative appearance of the bakery good.

A second example container configuration includes a dome-shaped cover and a base configured to hold the pan containing the bakery good. The cover is typically configured to engage a peripheral rim or sidewall element to secure the pan within the container. Since the container includes a base element, this type of container configuration requires additional packaging material thereby increasing the cost of the container and placing an increased burden on the retailer (or end consumer of the bakery good) in terms of disposing the additional packaging material.

Other container configurations include modifications to the pan holding the bakery good, such as indentations into the pan, so that the pan acts as a shock-absorbing base shell. These types of modifications, however, generally offer little protection to decorative elements of the bakery good which are typically damaged by contact associated with the cover of the container during transport and/or distribution.

Accordingly, there is a need for alternative packaging for providing increased protection to food products, particularly bakery goods of the type containing decorative elements that are easily damaged during transport and/or distribution.

SUMMARY

The disclosure provides a solution to packaging bakery goods of decorative elements. A cover shell and container assembly for packaging a food product, especially those having decorative elements that can be damaged during distribution and/or transport of the food product, is disclosed. The cover shell is preferably made from a transparent plastic material so that the food product can be viewed through the cover shell.

The cover shell includes inwardly projecting standoffs with a crust supporting surface arranged at intervals about the cover shell. The inwardly projecting standoffs act as recessed areas that protect food products during transport and/or distribution. One example of a food product is a pie with a crust. In the application of the pie, the inwardly projecting standoffs serve to hold the pie crust firmly against a pie tin or tray. The inwardly projecting standoffs uniquely abut the edge of the pie crust thereby helping to prevent lateral shifting of the pie. Moreover, the crust support surface acts as an entrapment for the pie crust to prevent vertical shifting within a pie tin or tray. In addition, the inwardly projecting standoffs and the crust supporting surface add rigidity to the cover shell to prevent buckling or collapsing of the cover shell. The crust supporting surface also exerts an entrapment force upon the rim of a pie tin or tray to provide stability.

The cover shell comprises a top element, having a planar region and a center region, and a side wall having an upper side wall integrally connected to the top element and a lower side wall integrally connected to an outward projecting peripheral rim element. The planar region of the cover shell can include one or more reinforcing ribs radiating in an outward orientation from the center region of the cover shell. One or more reinforcing ribs of the planar region can be integral with an upward extending reinforcing rib at a peripheral edge of the planar region to increase the rigidity or stability of the cover shell.

The outward projecting peripheral rim element of the cover shell comprises a flange member extending downward from a terminating end of the outward projecting peripheral rim element. The outward projecting peripheral rim element is configured to receive a rim element of a pan or tray comprising an outer peripheral edge and an inner peripheral edge. The flange member of the outward projecting peripheral rim element is configured to releasably engage the outer peripheral edge of the rim element of the pan or tray to secure the cover shell to the pan or tray, forming a container assembly. The flange member of the cover shell can include a protruding ridge or ridge segment to positively engage the rim element of a pan or tray to secure the cover shell to the pan or tray.

The side wall of the cover shell comprises a plurality of upward extending reinforcing ribs and a plurality of inward projecting standoffs. Each inward projecting standoff comprises a base region which is integral to the outward projecting peripheral rim element of the cover shell. The base region of the standoffs comprises a crust supporting surface that extends inwardly beyond the inner peripheral edge of the pan or tray when the cover shell is secured to the pan or tray. When secured to a pan or tray containing a pie having a crust, a lower crust supporting surface or upper crust supporting surface of the inward projecting standoffs abut a top edge or exterior side wall of the pie crust to prevent movement of the pie within the pan or tray and reduce damage to decorative elements of the pie adjacent to the top edge of the pie crust.

This summary is provided to introduce a selection of concepts in a simplified form that is further described below in the Detailed Description. This summary is not intended to identify key features or essential features of the claimed subject matter, nor is it intended to be used to limit the scope of the claimed subject matter.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Food products, such as pies, cakes, brownies, cookies, and other bakery goods, often contain decorative elements, such as cream, frosting, and/or icing elements, that can be damaged during distribution and/or transport rendering the product less desirable to the end consumer. One popular food product is the cream pie which often includes decorative whipped cream rosettes positioned along the edge of the pie crust. Although a cream pie will be used as one example of a food product to describe a cover shell and container assembly in accordance with the principles of the disclosure, it is understood that the cover shell and container assembly of the disclosure is suitable for packaging other food products, including pies, tarts, cakes, brownies, cookies, and the like that contain decorative elements, such as cream, frosting, and/or icing elements, which can be damaged during distribution and/or transport of the food product.

Utilizing conventional packing systems, it is difficult to distribute or transport a creme pie without any ruins to its whipped cream topping or base. Damage to the decorative elements of the pie can be reduced by minimizing shifting and/or sliding of the pie during distribution or transport by utilizing a low cost cover shell of the disclosure which stabilizes the pie and aids in protecting the decorative elements of the pie while minimizing the amount of packing material. As will be described in more detail, the cover shell of the disclosure includes a plurality of stand-offs that reduces damage to decorative elements of food product and provides a container assembly for the food product having increased rigidity and stability.

A cover shell according to the principles of the disclosure can be made from a plastic material, such as a thermoplastic material. The cover shell can be made using conventional techniques, including injection molding, injection blow molding, compression molding, injection stretch molding, composite injection molding, roto-molding, and the like. Thermoforming the cover shell from plastic sheet is particularly preferred. The thermoplastic material includes polyesters, polystyrenes, polypropylenes, polyethylenes, and mixtures thereof. In an embodiment, the cover shell is formed from a thermoplastic sheet which has been pre-cut or in the form of a continuous web or roll formed. Preferably the cover shell is made of a see-through or transparent plastic material allowing for the viewing of a food product through the cover shell.

Figure 1:
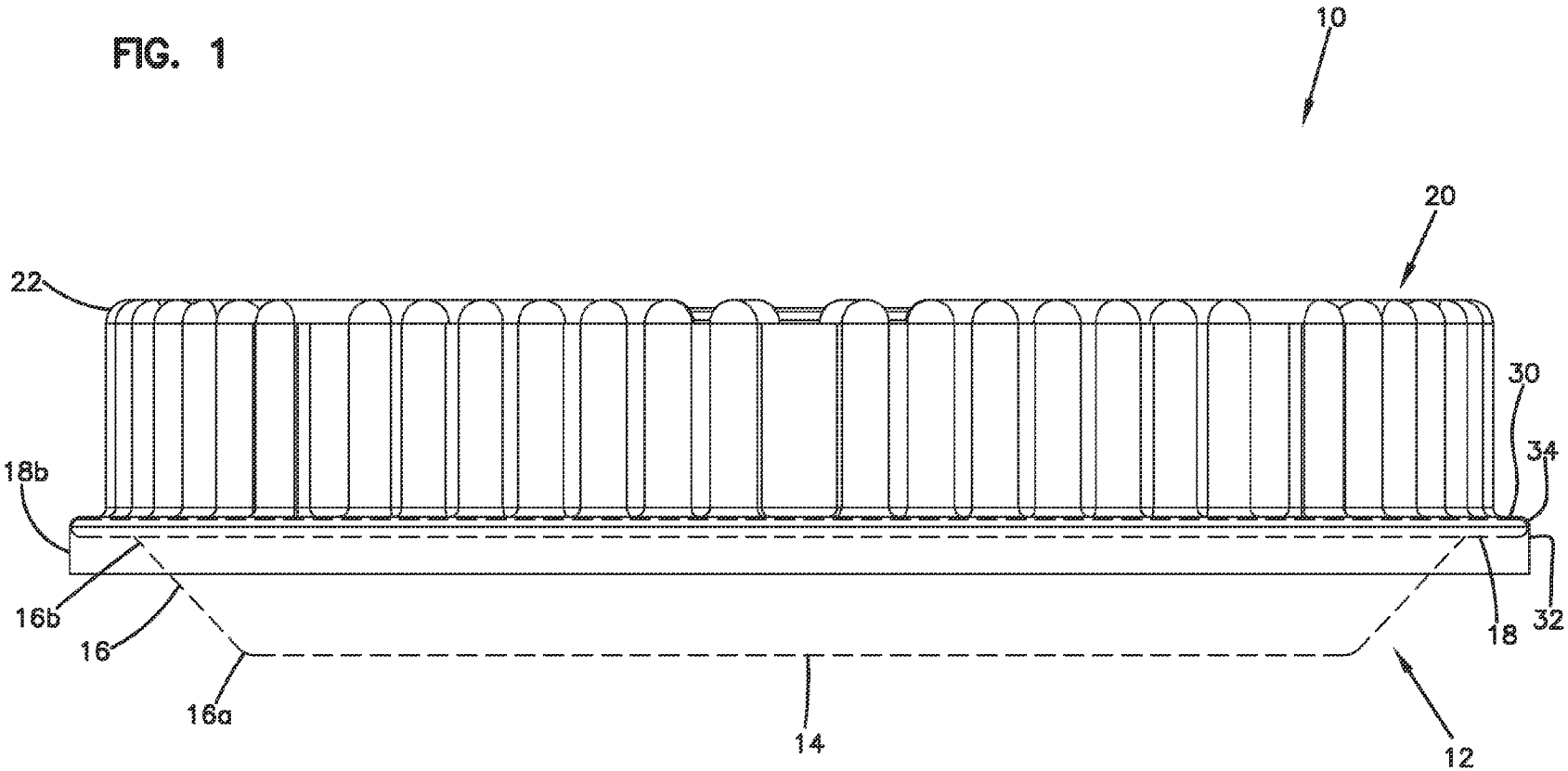
FIG. 1 is a side view of a container assembly in accordance with the principles of the present disclosure.

Referring now to FIG. 1, a cover shell 20 for packaging a food product, such as pies, cakes, brownies, and cookies containing decorative cream, frosting and/or icing elements, such as cream, frosting, and/or icing elements, that minimizes damage to the appearance and quality if the food product is shown. The cover shell 20 can releasably engage a pan or tray 12 to form a container assembly 10 comprising the cover shell 20 secured to the pan or tray 12. When secured to the pan or tray 12, the cover shell 20 encloses and protects a food product, such as a pie, tart, brownie, cookie, cake, and the like, seated within the pan or tray 12 without damaging the food product.

The pan or tray 12 generally comprises a base 14 and a sidewall 16 defining an interior volume of the pan or tray 12 for receiving a food product. The side wall 16 comprises a lower side wall 16*a* that is integrally connected to the base 14 of the pan or tray 12 and an upper side wall 16*b* that is integrally connected to a rim element 18 of a pan or tray 12. The side wall 16 can be oriented at an obtuse or acute angle extending outward from the base 14. The rim element 18 comprises an outer peripheral edge 18*b*. The pan or tray 12 can be made of a material suitable for holding a food product, including but not limited to plastic, tin, glass, and metallic materials such as aluminum, steel, tin, and the like. In an embodiment, the pan or tray 12 is metal. In another embodiment, the pan or tray 12 is plastic.

Figure 2:
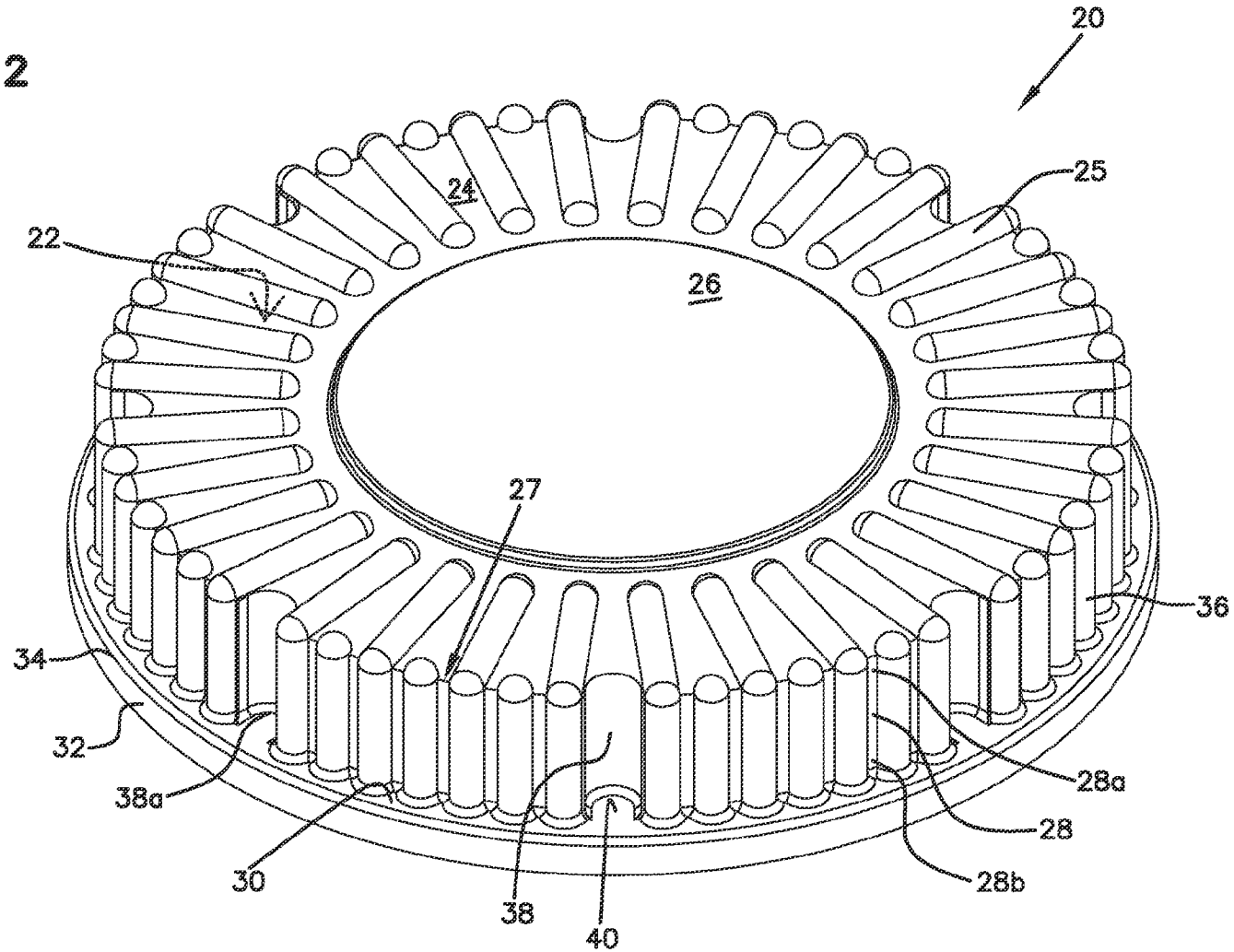
FIG. 2 is a perspective view of the cover shell of FIG. 1.

Referring to FIG. 2, cover shell 20 comprises a top element 22, a side wall 28, and an outward projecting peripheral rim element 30. The cover shell 20 in FIG. 2 is shown as a circular cover shell for illustrative purposes. The cover shell 20, however, can be any shape, such as a square, circle, rectangle, or oval, as is commonly used for food containers or food packaging. The outward projecting peripheral rim element 30 comprises a flange member 32 that extends downward from a terminating end 34 of the outward projecting peripheral rim element 30. The cover shell can be sized to fit any size of pan or tray. For example, circular pans and trays which are commonly used for packaging a food product, such as a pie, fruit tart, or cake, generally range in diameter from about 3 inches to about 16 inches dependent on the size of the food product. In an embodiment, the diameter of the cover shell 20 comprises from about 3 inches to about 16 inches as measured from the terminating end 34 of the outward projecting peripheral rim element 30. In an embodiment, the diameter of the cover shell 20 comprises from about 8 inches to about 12 inches as measured from the terminating end 34 of the outward projecting peripheral rim element 30. In yet another embodiment, the diameter of the cover shell 20 comprises from about 8 inches to about 10 inches as measured from the terminating end 34 of the outward projecting peripheral rim element 30.

The top element 22 comprises a planar region 24 and a center region 26. The center region 26 can extend upwardly from the planar region 24, can extend downwardly from the planar region 24, or can be coplanar with the planar region 24. In one aspect of the present disclosure, the center region 26 of the cover shell 20 can be adapted to engage the base of the pan or tray such that, when the base of one container assembly is stacked on the cover shell 20 of another container assembly, there is a centering and interlocking action between the base of the pan or tray and the center region of the cover shell that prevents lateral displacement of the container assemblies when stacked.

The side wall 28 of cover shell 20 comprises an upper side wall 28*a* integrally connected to the circular top element 22 and a lower side wall 28*b* integrally connected to an outward projecting peripheral rim element 30. The height of the side wall 28 can be adjusted to provide adequate clearance between a food product and the top element 22 of the cover shell 20 when the cover shell is secured to a pan or tray. In an embodiment, the side wall 16 comprises a height of about 1.25 inches to about 3.0 inches. The side wall 28 contains a plurality of inward projecting standoffs 38. Each standoff 38 comprises a base region 38*a* that is integral to the outward projecting peripheral rim element 30. The inward projecting standoffs 38 may be configured in various shapes such as a circle, semi-circle, triangle, square, oval, semi-oval, and the like. The standoffs 38 extend upwardly from the base region 38*a* and can terminate in the planar region 24. In an embodiment, one or more of the inward projecting standoffs 38 terminate in the upper side wall 28 such that the one or more of the standoffs are not integral to the planar region 24.

Figure 3:
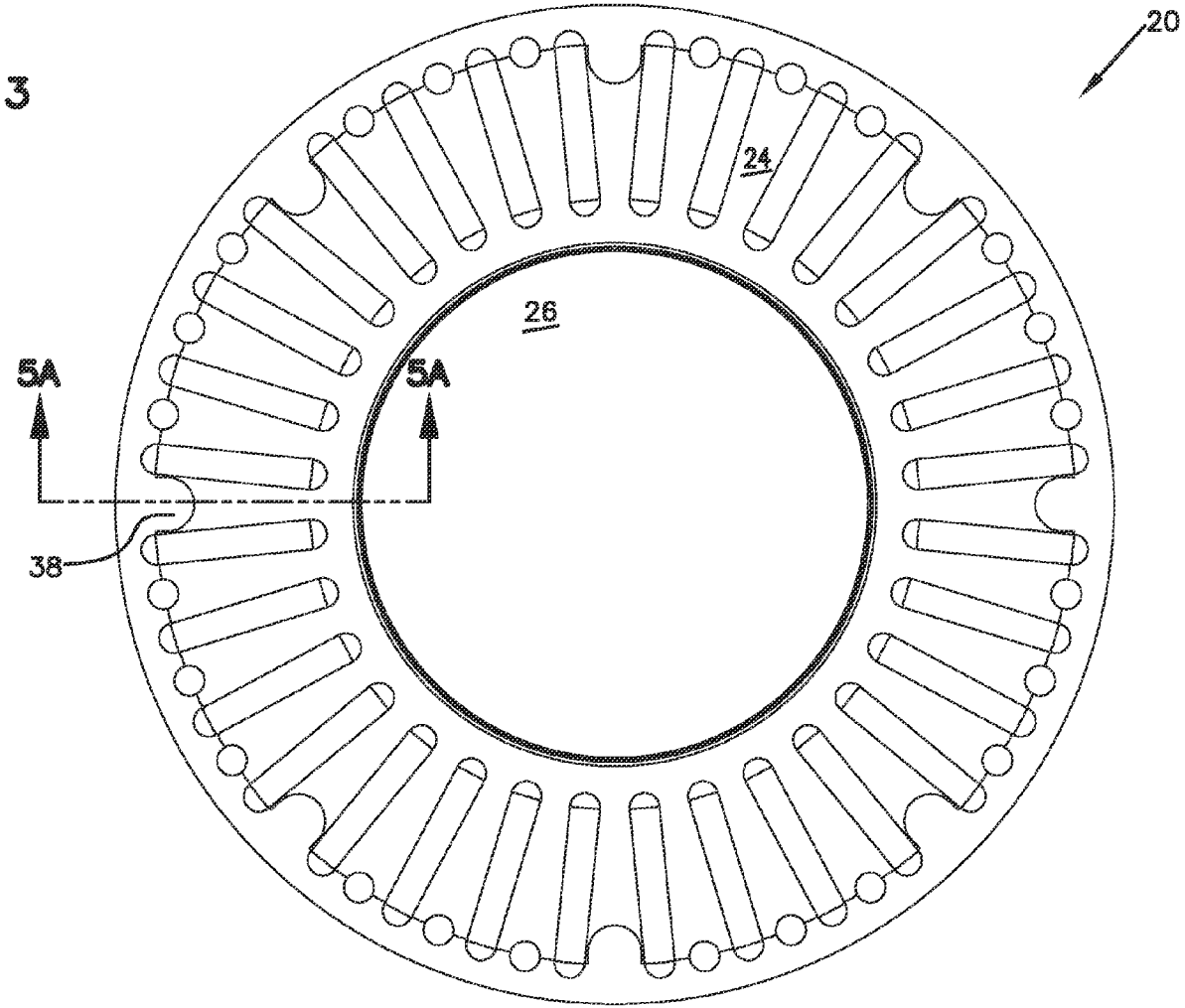
FIG. 3 is a top view of the cover shell of FIG. 2.
Figure 4:
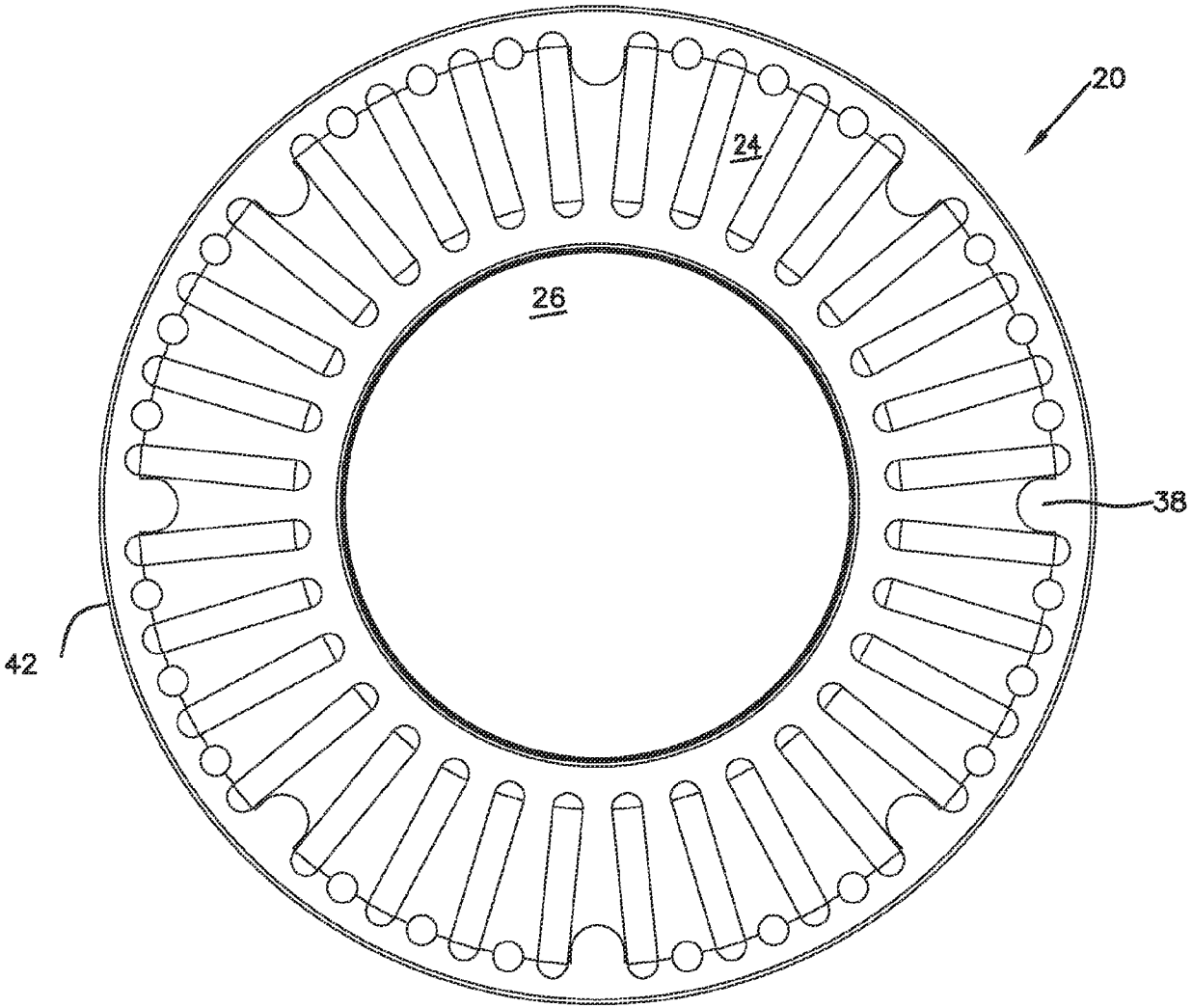
FIG. 4 is a bottom view of the cover shell of FIG. 2.

A top view of the cover shell 20 of FIG. 2 is shown in FIG. 3. As shown in FIG. 4, the inward projecting standoffs 38 extend inwardly from the side wall 28 into the planar region 24. The width and protruding depth of the standoffs 38 can be configured as necessary to minimize shifting minimizing shifting and/or sliding of a food product when the cover shell is secured to a pan or tray and to increase the rigidity and stability of the cover shell. In an embodiment, the standoffs have a width of from about 0.25 inch to about 1.0 inch and extend from about 0.125 inch to about 1.0 inch inwardly from the side wall 28 into the planar region 24. In another embodiment, the standoffs 28 extend from about 0.125 inch to about 0.5 inch inwardly from the side wall 28 into the planar region 24.

Figure 5A:
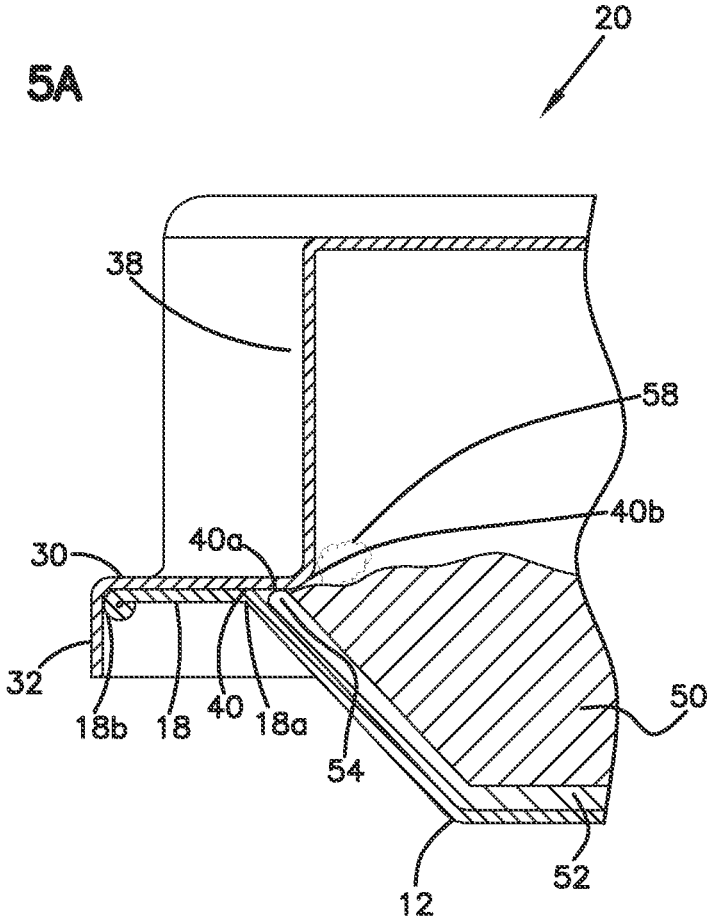
FIG. 5A is a cross-sectional view of the container assembly of FIG. 1 showing the pan containing a pie having a crust in which the cover shell is engaged to the pan taken through line 5A-5A of FIG. 3.

FIG. 5A shows a cross-sectional view of the container assembly 10 of FIG. 1 in which the pan or tray 12 is holding a pie 50 having a crust 52. The crust supporting surface 40 of the standoff 38 extends inwardly beyond the inner peripheral edge 18*a* of the rim element 18 of the tray or pan 12 when the cover shell 20 is secured to the pan or tray 12. The width and protruding depth of the crust supporting surface 40 of the standoff 38 can be configured as necessary to minimize shifting minimizing shifting and/or sliding of a food product when the cover shell is secured to a pan or tray. In an embodiment, the crust supporting surface 40 comprises a width of from about 0.25 inch to about 1.0 inch and extends from about 0.125 inch to about 1.0 inch inwardly from the side wall 28. In another embodiment, the crust supporting surface 40 extends from about 0.125 inch to about 0.5 inch inwardly from the side wall 28.

The crust supporting surface 40 comprises a lower crust supporting surface 40*a* and an upper crust supporting surface. In FIG. 5A, the lower crust supporting surface 40*a* abuts the top edge 54 of crust 52 preventing pie 50 from lifting out of or shifting within the pan or tray 12. The inward protruding depth of standoff 38 is configured such that the lower crust supporting surface 40*a* abuts the top edge 54 of crust 52 but the upper crust supporting service 40*b* does not contact decorative element 58 adjacent to the top edge 54 of the pie 52.

Figure 5B:
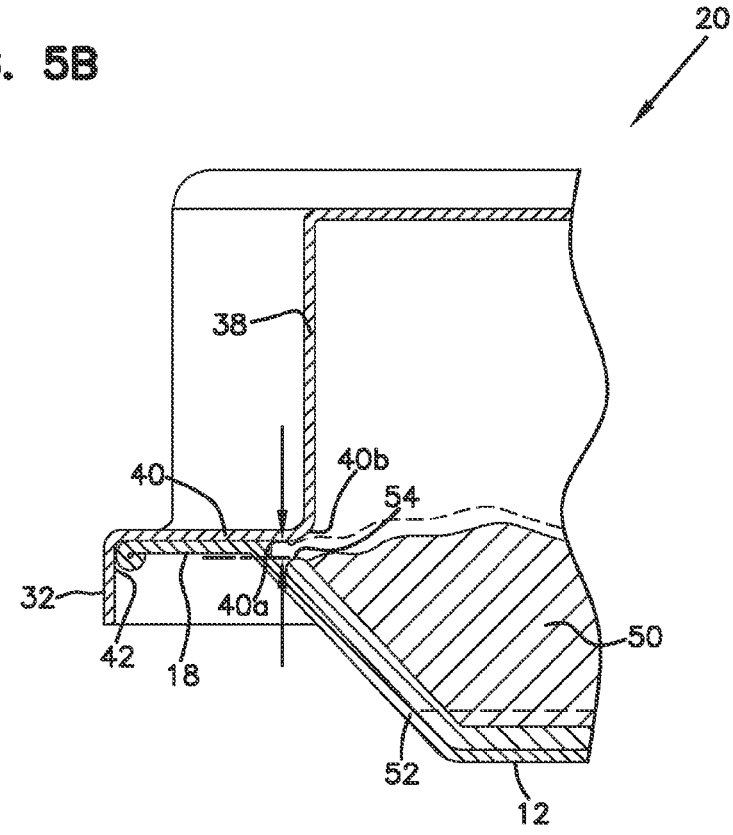
FIG. 5B is a cross-sectional view of the container assembly of FIG. 1 showing an alternative configuration of the crust in FIG. 5A.

FIG. 5B shows an alternative configuration of the crust 52 of the pie 50. In FIG. 5B, the top edge 54 of crust 52 terminates below the inner peripheral edge 18*a* of the rim element 18 of the pan or tray 12. The lower crust supporting surface 40*a* of standoff 38 defines a vertical clearance, represented by a dotted line, the supporting surface 40*a* it and top edge 54 of crust 52 for exerting an entrapment force upon the top edge of the crust to prevent the pie 50 from raising out of the pan or tray 12.

Figure 5C:
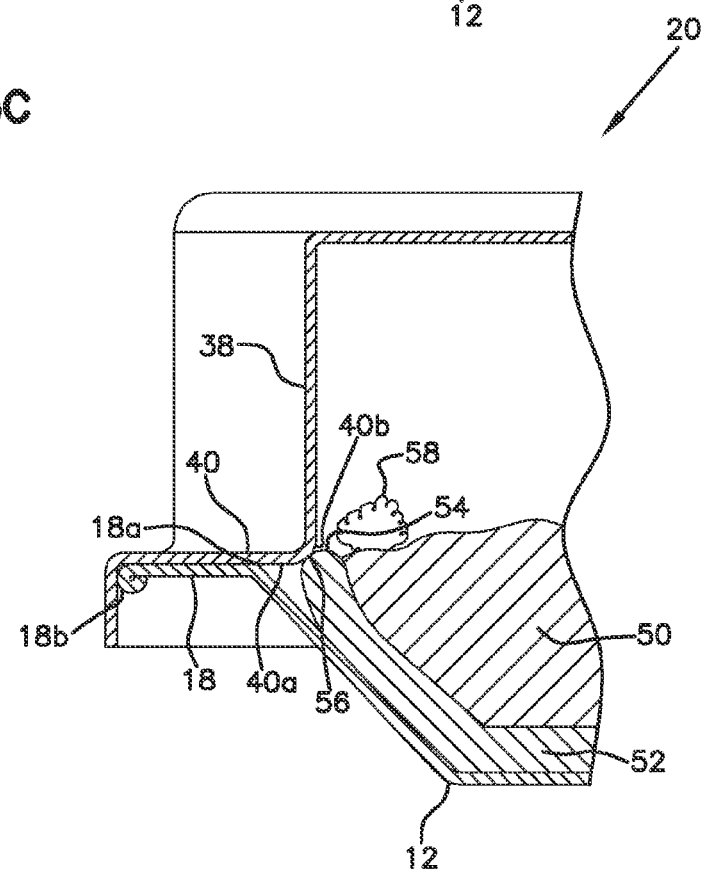
FIG. 5C is a cross-sectional view of the container assembly of FIG. 1 showing an alternative configuration of the crust in FIG. 5A.

FIG. 5C shows an alternative configuration of the crust 52 of the pie 50. In FIG. 5C, the upper crust supporting surface 40*b* abuts the side wall 56 of the crust 52 preventing lateral movement of the pie 50. The inward protruding depth of standoff 38 is configured such that the upper crust supporting surface 40*b* abuts the side wall 56 of crust 52 but does not contact decorative element 58 adjacent to the top edge 54 of the pie 52.

Figure 6:
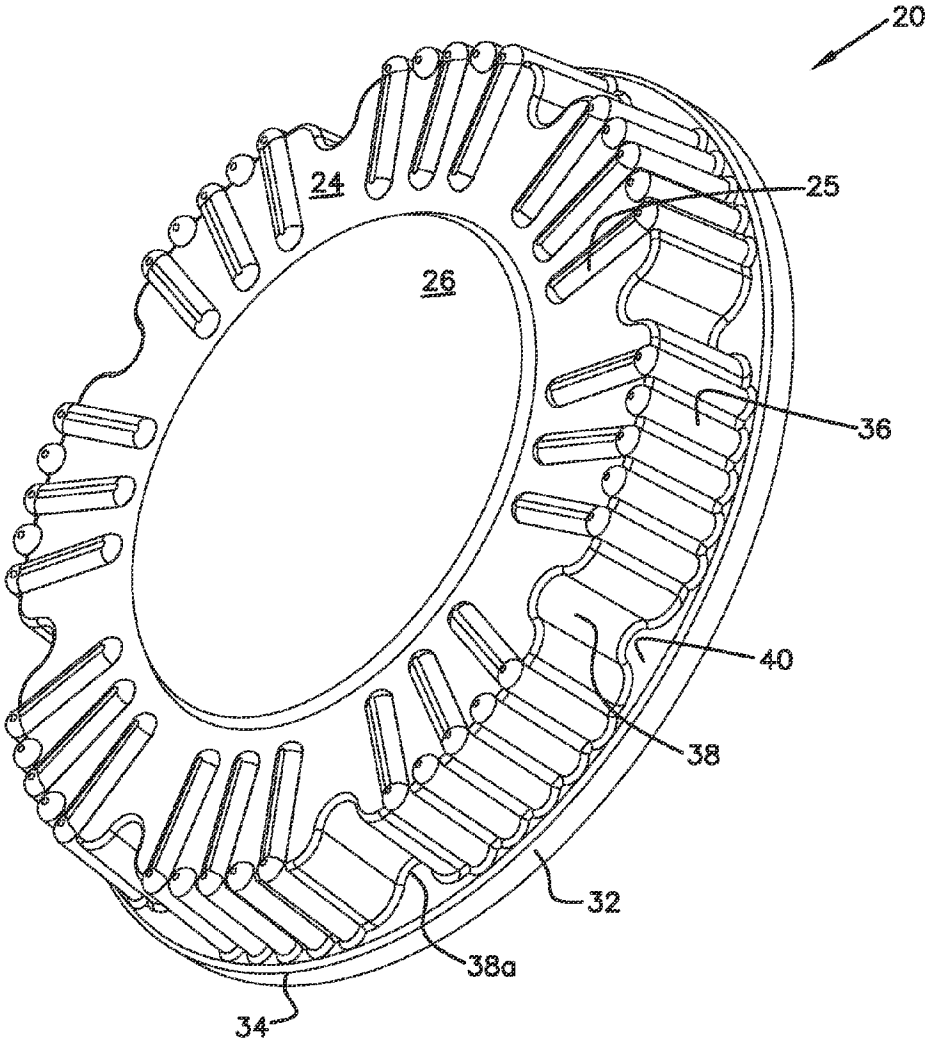
FIG. 6 is a perspective view of an alternative embodiment of a cover shell according to the principles of the present invention.

The number and spacing of the standoffs can be adjusted as necessary to minimize shifting minimizing shifting and/or sliding of a food product when the cover shell is secured to a pan or tray and/or to increase the rigidity and stability of the cover shell. FIG. 6 shows an embodiment of a cover shell 20 having an alternative standoff 38 and reinforcing rib 25, 36 arrangement.

In another embodiment, the standoffs are spaced evenly along the side wall of the cover shell. The standoffs can further be arranged as single standoffs, pairs of standoffs, or any other grouping or combination selected to minimize shifting or sliding of the food product when the cover shell is secured to the pay or tray. In an embodiment, the cover shell comprises four to twelve stand-offs that are spaced evenly around the side wall of the cover shell. In another embodiment, the cover shell comprises six to 10 stand-offs that are spaced evenly around the side wall of the cover shell.

Referring now to FIG. 2, the side wall 28 of the cover shell 20 can include one or more upward extending reinforcing ribs 36 to provide rigidity to the cover shell 20 and improve stability of the container assembly when the cover shell 20 is secured to a pan or tray. The upward extending reinforcing ribs 36 also aid in resisting downward crushing forces on the cover shell 20. The upward extending reinforcing ribs 36 can be concave or convex and cylindrical, semi-cylindrical, tubular, semi-tubular triangular, semi-triangular, rectangular, semi-rectangular and the like. A cross-section of the upward extending reinforcing rib 36 perpendicular to a longitudinal axis of the reinforcing rib can be arcuate, parabolic, circular, semi-circular, triangular, square, semi-square, rectangular, semi-rectangular, ovular, semi-ovular, and the like. The reinforcing ribs 36 extend upwardly from the peripheral rim element 30 and can terminate in the planar region 24. In an embodiment, one or more of the reinforcing ribs 36 terminate in the upper side wall 28 such that the one or more of the reinforcing ribs are not integral to the planar region 24.

The number and spacing of the reinforcing ribs can be adjusted as necessary to increase the rigidity and stability of the cover shell. In an embodiment, the reinforcing ribs 36 are spaced evenly along the side wall 28 of the cover shell 20. The reinforcing ribs 36 can further be arranged as single reinforcing ribs, pairs of reinforcing ribs, or any other grouping or combination selected to achieve the desired rigidity or stability. In an embodiment, cover shell 20 comprises from one to ten reinforcing ribs 36 between standoffs 38.

The planar region 24 of the cover shell 20 can include one or more reinforcing ribs 25 radiating in an outward orientation from the center region 26 to provide rigidity to the cover shell 20 and improve stability of the container assembly when the cover shell 20 is secured to a pan or tray. The reinforcing rib 25 can terminate at the exterior peripheral edge 27 of the planar region 24 or can be integral with an upward extending reinforcing rib 36 at the peripheral edge 27 of the planar region 24. One of more of the reinforcing ribs 25 can be integral to the upward extending reinforcing ribs 36. The reinforcing ribs 25 in planar region 24 also aid in resisting downward crushing forces on the cover shell 20. The reinforcing ribs 25 can be concave or convex and cylindrical, semi-cylindrical, tubular, semi-tubular triangular, semi-triangular, rectangular, semi-rectangular and the like. A cross-section of the reinforcing rib 25 perpendicular to a longitudinal axis of the reinforcing rib 25 can be arcuate, parabolic, circular, semi-circular, triangular, square, semi-square, rectangular, semi-rectangular, ovular, semi-ovular, and the like.

The number and spacing of the reinforcing ribs 25 in planar region 24 can be adjusted as necessary to increase the rigidity and stability of the cover shell. In an embodiment, the reinforcing ribs 25 are evenly spaced along the exterior peripheral edge 27 of the planar region 24. The reinforcing ribs 25 can further be arranged as single reinforcing ribs, pairs of reinforcing ribs, or any other grouping or combination selected to achieve the desired rigidity or stability. In an embodiment, cover shell 20 comprises from one to ten reinforcing ribs 25 between standoffs 38. In an embodiment, every other reinforcing rib 25 in the planar region 24 is integral to an upward extending reinforcing rib 36 in side wall 38. In an embodiment, every other third, fourth, or fifth reinforcing rib 25 in the planar region 24 is integral to an upward extending reinforcing rib 36 in side wall 38.

Referring to FIG. 1, the outward projecting peripheral rim element 30 of cover shell 10 is configured to receive a rim element of a pan or tray. The outward projecting peripheral rim element 30 comprises a flange member 32 that extends downward from a terminating end 34 of the outward projecting peripheral rim element 30. The flange member 32 is configured to releasably engage the rim element of a pan or tray to secure the cover shell 20 to the pan or tray. As shown in FIGS. 5A-5C, the flange member 32 releasably engages an outer peripheral edge 18*b* of the pan or tray 12 to secure the cover shell 20 to the pan or tray 12.

As shown in FIG. 4, the flange member 32 can include a protruding ridge 42 molded within the flange member 32. The protruding ridge 42 can be a continuous ridge or a plurality of segments spaced at intervals within the flange member 32. The protruding ridge 42 is configured to positively engage the rim element of a pan or tray to secure the cover shell 20 to a pan or tray. As shown in FIG. 5B, the protruding ridge 42 positively engages the outer peripheral edge 18*b* of the rim element 18 of the pan or tray 12 to secure the cover shell 20 to the pan or tray 12.

While this invention has been particularly shown and described with references to preferred embodiments thereof, it will be understood by those skilled in the art that various changes in form and details may be made therein without departing from the scope of the invention encompassed by the appended claims. The drawings are not necessarily to scale, emphasis instead being placed upon illustrating the principles of the invention and other modifications within the scope. Any such modifications or variations that fall within the purview of this description are intended to be included therein as well. It is understood that the description herein is intended to be illustrative only and is not intended to be limitative.

What is claimed is:

1. A cover shell for packaging a bakery good, comprising:

a top element comprising a top surface;

a side wall comprising an upper side wall integrally connected to the top element and a lower side wall integrally connected to an outward projecting peripheral rim element;

the outward projecting peripheral rim element comprising a flange member extending downward from a terminating end of the outward projecting peripheral rim element, wherein the outward projecting peripheral rim element is configured to receive a rim element of a pan or tray comprising an outer peripheral edge and an inner peripheral edge, the flange member configured to releasably engage the outer peripheral edge of the rim element of the pan or tray to secure the cover shell to the pan or tray;

the side wall comprising a plurality of upward extending reinforcing ribs and a plurality of inward projecting standoffs, the plurality of upward extending reinforcing ribs extending outwardly beyond an exterior peripheral edge of the side wall and the plurality of inward projecting standoffs extending inwardly from the exterior peripheral edge of the side wall, the plurality of inward projecting standoffs between spaced between the plurality of upward extending reinforcing ribs, each inward projecting standoff comprising a base region which is integral to the outward projecting peripheral rim element, the base region having a crust supporting surface wherein the crust supporting surface extends inwardly beyond the inner peripheral edge of the pan or tray when the cover shell is secured to the pan or tray.

2. The cover shell according to claim 1, wherein the crust supporting surface of the inward projecting standoff comprises a lower crust supporting surface or upper crust supporting surface abutting a top edge or exterior side wall of a pie crust when the cover shell is secured to a pan or tray comprising the pie crust.

3. The cover shell according to claim 1, wherein the top surface includes a generally planar region and a center region located in the middle thereof, and the planar region includes one or more reinforcing ribs radiating in an outward orientation from the center region of the cover shell.

4. The cover shell according to claim 3, wherein the inward projecting standoffs extend upwardly from the outward projecting peripheral rim element and terminate in the planar region.

5. The cover shell according to claim 3, wherein the planar region is annular.

6. The cover shell according to claim 3, wherein the one or more reinforcing ribs are convex.

7. The cover shell according to claim 3, wherein one or more reinforcing ribs of the planar region are integral with an upward extending reinforcing rib at a peripheral edge of the planar region.

8. The cover shell according to claim 1, wherein the inward projecting standoffs are evenly spaced along the sidewall.

9. The cover shell according to claim 8, wherein the cover shell comprises 4 to 12 standoffs.

10. The cover shell according to claim 1, wherein the cover shell comprises from one to ten upward extending reinforcing ribs between standoffs.

11. The cover shell according to claim 10, wherein the upward extending reinforcing ribs are convex.

12. The cover shell according to claim 1, wherein the flange member comprises a protruding ridge or ridge segment configured to positively engage the rim element of a pan or tray.

13. The cover shell of according to claim 1, comprising a see-through or transparent plastic material.

14. The cover shell according to claim 1, wherein the plastic material is a thermoplastic material.

15. The cover shell according to claim 1, wherein the crust supporting surface of each of the standoffs comprises a width of about 0.25 inch to about 1.0 inch and extends from about 0.125 inch to about 1.0 inch inwardly from the side wall of the cover shell.

16. The cover shell according to claim 1, comprising a diameter of about 3 inches to about 16 inches.

17. A container assembly for packaging a bakery good, the container assembly comprising:

a pan or tray comprising a base and a sidewall defining an interior volume of the pan or tray for receiving a food product, the side wall comprising a lower side wall integrally connected to the base and an upper side wall integrally connected to a rim element, the rim element comprising an outer peripheral edge and an inner peripheral edge; and a cover shell comprising:

a top element comprising a top surface;

a side wall comprising an upper side wall integrally connected to the top element and a lower side wall integrally connected to an outward projecting peripheral rim element, the side wall comprising a plurality of upward extending reinforcing ribs and a plurality of inward projecting standoffs, the plurality of upward extending reinforcing ribs extending outwardly beyond an exterior peripheral edge of the side wall and the plurality of inward projecting standoffs extending inwardly from the exterior peripheral edge of the side wall, the plurality of inward projecting standoffs being spaced between the plurality of upward extending reinforcing ribs, each inward projecting standoff comprising a base region integral to the outward projecting peripheral rim element, the base region having a crust supporting surface wherein the crust supporting surface extends inwardly beyond the inner peripheral edge of the pan or tray when the cover shell is secured to the pan or tray;

the outward projecting peripheral rim element comprising a flange member extending downward from a terminating end of the outward projecting peripheral rim element, wherein the outward projecting peripheral rim element is configured to receive the rim element of the pan or tray and the flange member is configured to releasably engage the outer peripheral edge of the rim element of the pan or tray to secure the cover shell to the pan or tray.

18. The container assembly according to claim 17, wherein the top surface includes a generally planar region and a center region, and the planar region of the cover shell includes one or more reinforcing ribs radiating in an outward orientation from the center region of the cover shell.

19. The container assembly according to claim 18, wherein the inward projecting standoffs extend upwardly from the outward projecting peripheral rim element and terminate in the planar region.

20. The container assembly according to claim 18, wherein the planar region is annular.

21. The container assembly according to claim 18, wherein the one or more reinforcing ribs are convex.

22. The container assembly according to claim 18, wherein one or more reinforcing ribs of the planar region are integral with an upward extending reinforcing rib at a peripheral edge of the planar region.

23. The container assembly according to claim 17, wherein the cover shell comprises a see-through or transparent plastic material.

24. The container assembly according to claim 17, wherein the pan or tray is plastic, metal, or glass.

25. The container assembly according to claim 17, wherein the food product is a pie, fruit tart, cake, brownies, or cookies.

26. The container assembly according to claim 17, wherein the crust supporting surface of the inward projecting standoff comprises a lower crust supporting surface or upper crust supporting surface abutting a top edge or exterior side wall of a pie crust when the cover shell is secured to a pan or tray comprising the pie crust.

27. The container assembly according to claim 17, wherein the inward projecting standoffs are evenly spaced along the sidewall.

28. The container assembly according to claim 27, wherein the cover shell comprises 4 to 12 standoffs.

29. The container assembly according to claim 17, wherein the cover shell comprises from one to ten upward extending reinforcing ribs between standoffs.

30. The container assembly according to claim 29, wherein the upward extending reinforcing ribs are convex.

31. The container assembly according to claim 17, wherein the flange member of the cover shell comprises a protruding ridge or ridge segment configured to positively engage the rim element of the pan or tray.

32. The container assembly according to claim 17, wherein the crust supporting surface of each of the standoffs comprises a width of about 0.25 inch to about 1.0 inch and extends from about 0.125 inch to about 1.0 inch inwardly from the side wall of the cover shell.

* * * * *